US009346069B2

(12) United States Patent
Holzmann

(10) Patent No.: US 9,346,069 B2
(45) Date of Patent: May 24, 2016

(54) METERING DISPENSER

(76) Inventor: Werner Holzmann, Marktoberdorf (DE)

( * ) Notice: Subject to any disclaimer, the term of this patent is extended or adjusted under 35 U.S.C. 154(b) by 0 days.

(21) Appl. No.: 13/503,631

(22) PCT Filed: Oct. 23, 2010

(86) PCT No.: PCT/EP2010/006513

§ 371 (c)(1),
(2), (4) Date: Aug. 2, 2012

(87) PCT Pub. No.: WO2011/047882

PCT Pub. Date: Apr. 28, 2011

(65) Prior Publication Data

US 2012/0298694 A1 Nov. 29, 2012

(30) Foreign Application Priority Data

Oct. 23, 2009 (DE) ..... 20 2009 014 316 U

(51) Int. Cl.
*B67D 7/70* (2010.01)
*B05B 11/00* (2006.01)

(52) U.S. Cl.
CPC ..... *B05B 11/3095* (2013.01); *B05B 11/3056* (2013.01); *B05B 11/3084* (2013.01)

(58) Field of Classification Search
CPC ..... B05B 11/3084; B05B 11/3095; B05B 11/3056
USPC ..... 222/135, 144.5, 137, 145.5, 145.1, 222/145.7, 145.8, 383.1, 282, 287, 134
See application file for complete search history.

(56) References Cited

U.S. PATENT DOCUMENTS

| | | | | | |
|---|---|---|---|---|---|
| 4,454,964 | A * | 6/1984 | Sacher | 222/43 | |
| 4,826,048 | A * | 5/1989 | Skorka et al. | 222/137 | |
| 5,169,029 | A * | 12/1992 | Behar | B05B 11/3084 | 128/200.23 |
| 5,224,627 | A * | 7/1993 | Weag | 222/135 | |
| 5,634,571 | A * | 6/1997 | Cataneo et al. | 222/80 | |
| 5,848,732 | A * | 12/1998 | Brugger | 222/137 | |
| 6,454,135 | B1 * | 9/2002 | Brozell | B05B 11/3011 | 222/135 |
| 6,464,107 | B1 | 10/2002 | Brugger | | |
| 7,222,752 | B2 * | 5/2007 | Ponton | 222/134 | |
| 8,371,461 | B2 * | 2/2013 | Kountotsis | 215/6 | |
| 8,403,577 | B2 * | 3/2013 | Khoshnevis | 401/35 | |
| 8,418,887 | B2 * | 4/2013 | Milian et al. | 222/137 | |

FOREIGN PATENT DOCUMENTS

| | | | |
|---|---|---|---|
| DE | 3911089 | A1 | 10/1990 |
| DE | 3911089 | A1 * | 10/1990 |
| EP | 1104336 | B1 | 11/2006 |

* cited by examiner

*Primary Examiner* — Donnell Long
(74) *Attorney, Agent, or Firm* — Venable LLP; Michele V. Frank; F. Brock Riggs

(57) ABSTRACT

In order to provide a simple and installation-friendly design of a setting unit of a dispenser (10) for dispensing a substance consisting of at least two components from at least two containers, each having a pump unit (12*a*, 12*b*), by means of a moveable actuating device (40) for the pump units (12*a*, 12*b*) and a dispenser nozzle for the substance to be dispensed, according to the invention the setting unit (38) can be varied with respect to the distance thereof to the containers or pump units (12*a*, 12*b*), or with respect to the distance of the projections (61*a, b*) thereof in relation to a pivot axis (43) of the actuating device (40), in particular in opposite directions.

16 Claims, 11 Drawing Sheets

Figure 1A:
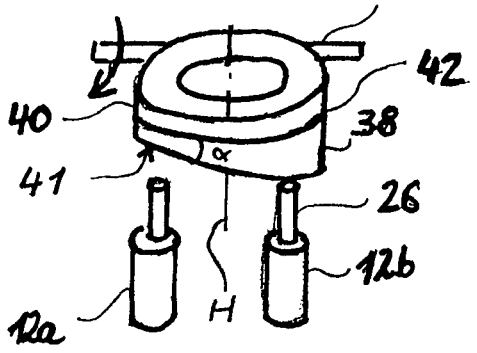

Fig 3A
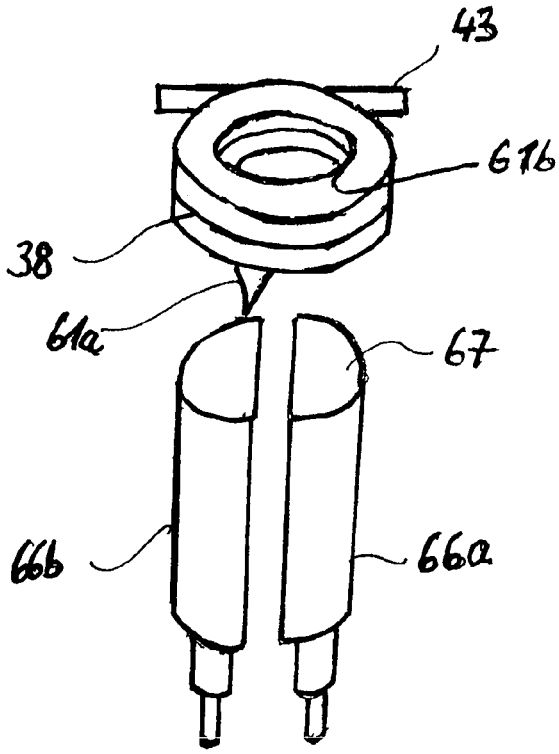
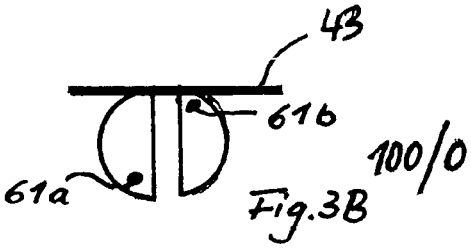
Fig.3B
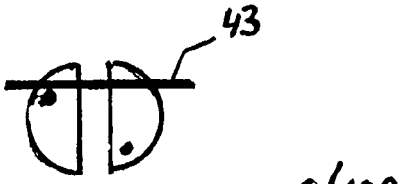
Fig 3C
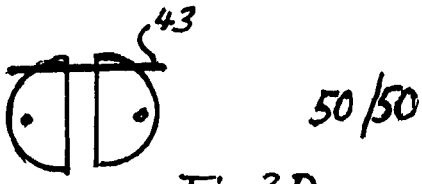
Fig. 3D

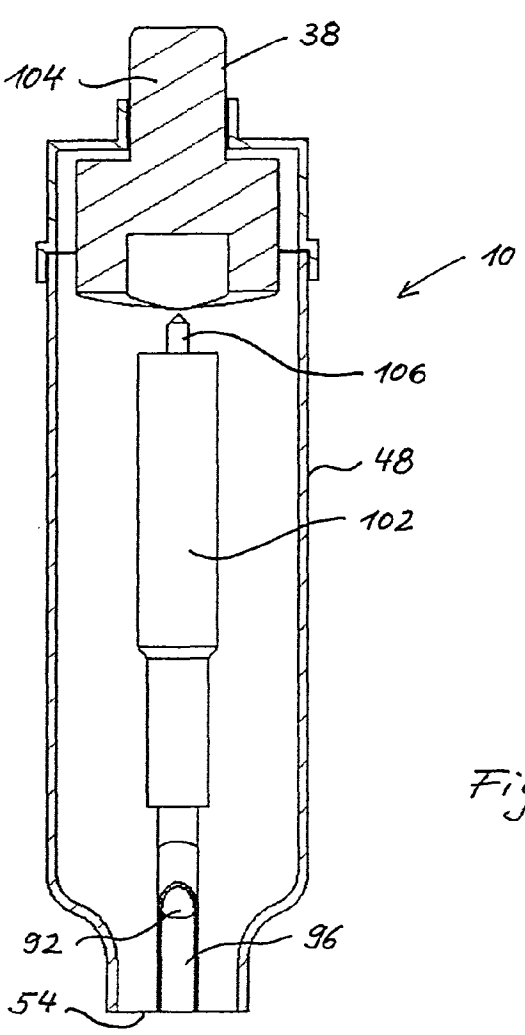
Fig. 5A
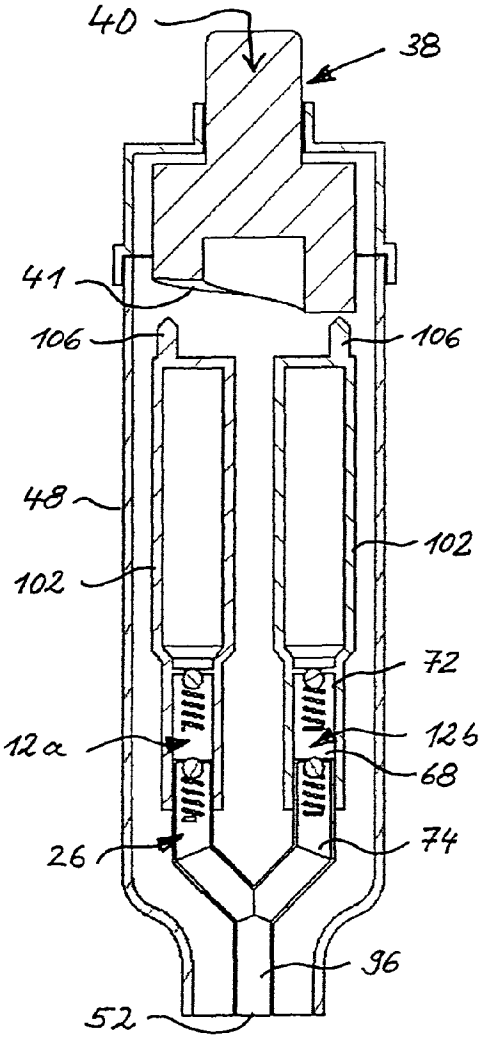

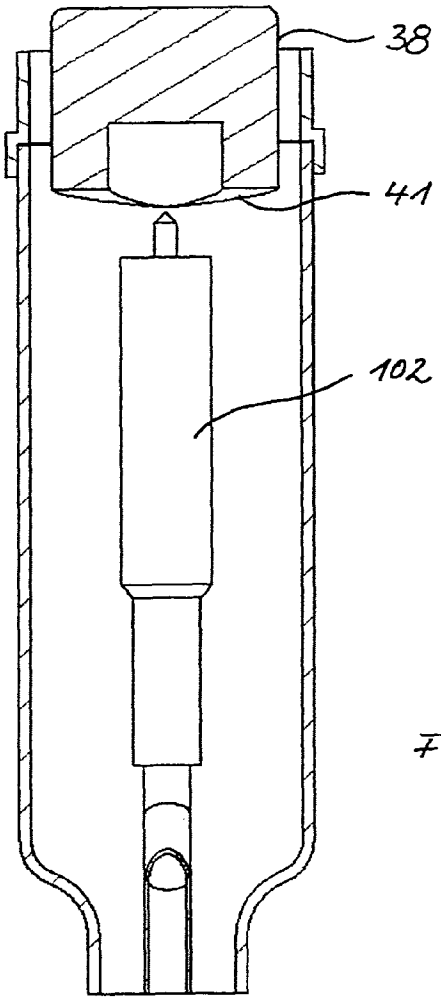
Fig. 5B
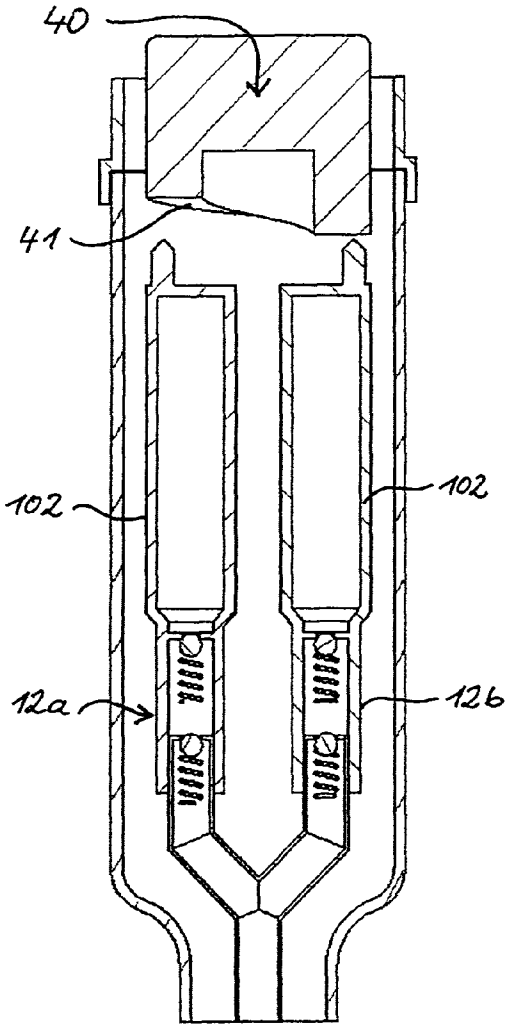

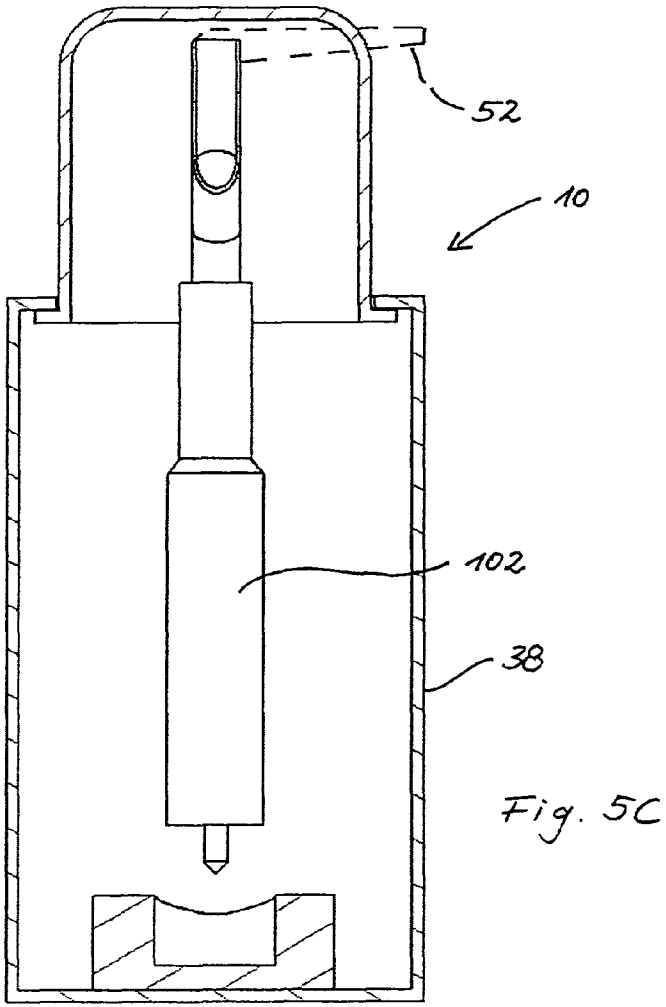
Fig. 5C
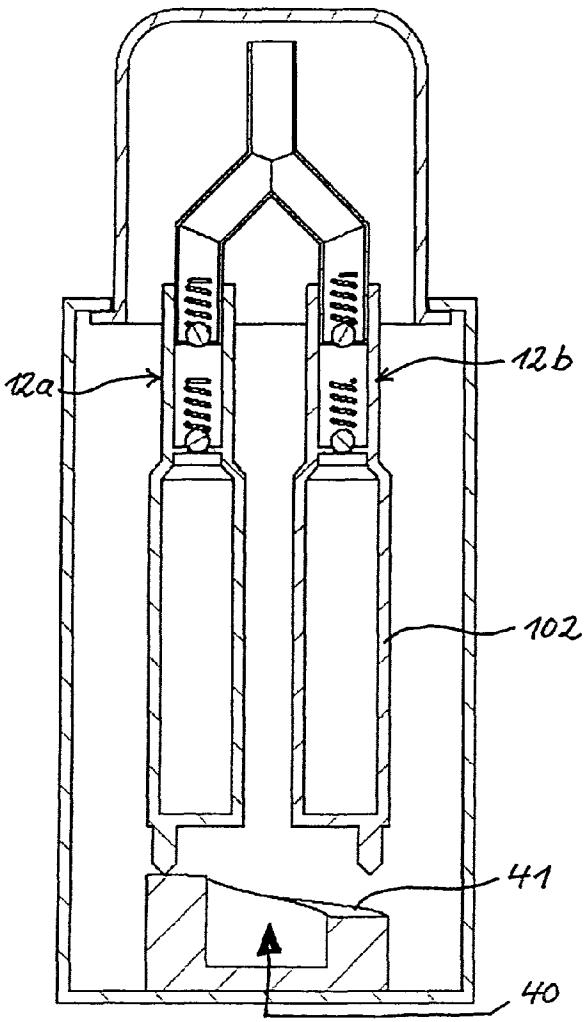

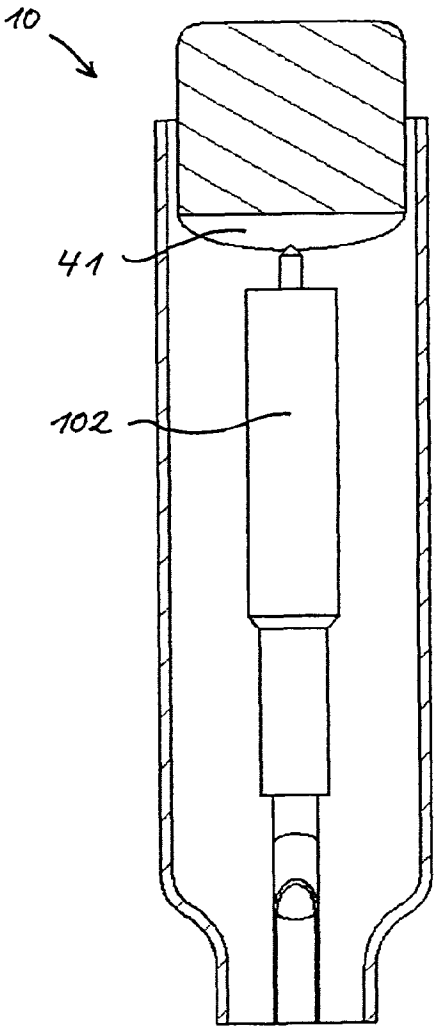
Fig. 5D
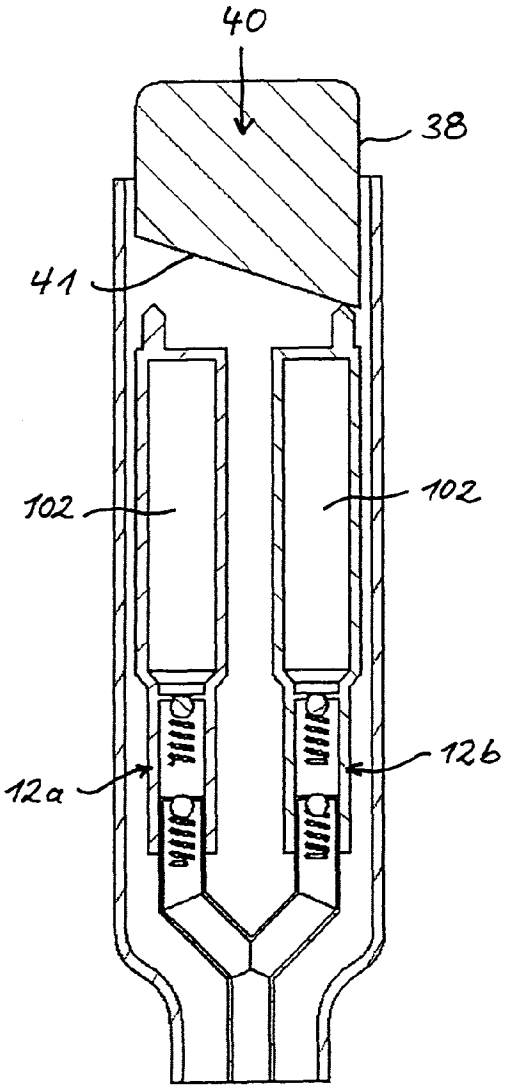

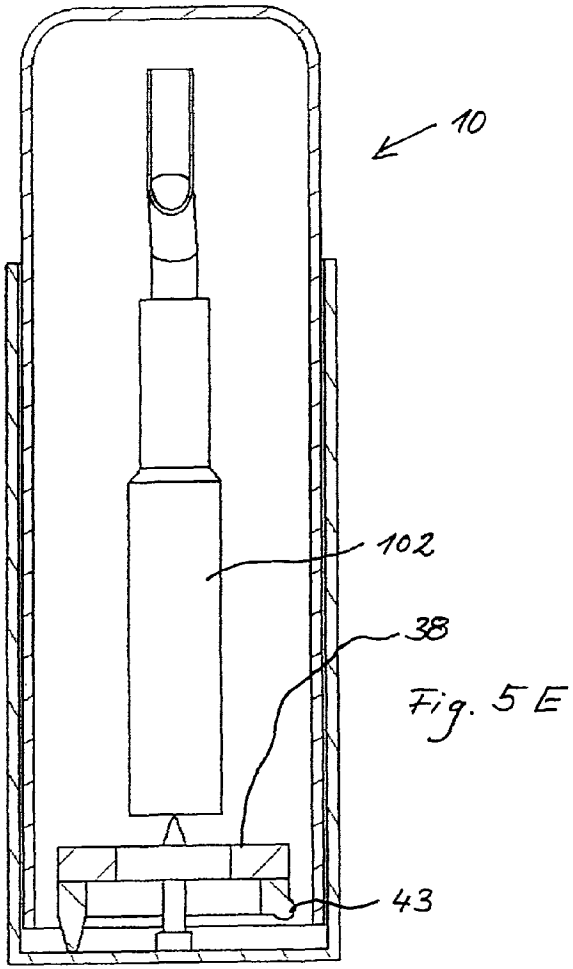
Fig. 5E
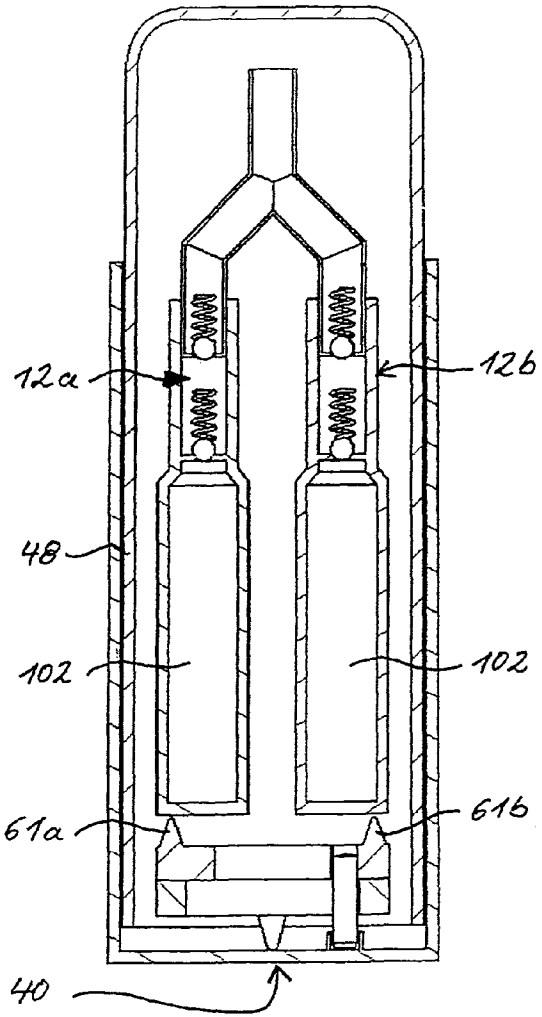

METERING DISPENSER

The invention relates to a dispenser for dispensing a substance consisting of at least two components, according to the pre-characterizing features of claim 1.

EP 1 104 336 discloses a dosing device, wherein the mixing ratio of two pasty or liquid fluid components is continuously adjustable. This dispenser provides a considerable relief for the consumer to choose the mixing ratio of the fluid components according to personal needs or the purpose of the mixed components. Therein two cartridges are provided in the dispenser with associated pumps, which are actuated via a moveable transmission element, which pivot axis is displaceable relative to the pumps or their pistons.

A disadvantage of the known dispenser is that the transmission element is also used to adjust the mixing ratio of the fluid components. In case of failure of the transmission element no delivery from the dispenser is possible. Moreover, because of the dual function of the transmission element, the structure and assembly is rather complicated.

Thus, the object of the present invention is to overcome the disadvantages of the prior art and to provide a dispenser, which comprises a structurally simple and easy to assemble adjustment mechanism for the mixing ratio.

This object is achieved by a dispenser having the features of claim 1. Advantageous embodiments of the invention are the subject of dependent claims.

According to the invention there is provided a dispenser for dispensing a substance consisting of at least two components, the dispenser comprises at least two containers for including the components of the substance. The container may be formed as a cartridge, i.e. with a rigid shell, as well as elastic bottles or bags. An embodiment is a fixed connection of the respective container with the dispenser, but detachable cartridges are also possible to enable the replacement of the cartridges and the movement in the dispenser during the dosing or dispensing process. The design of the container also depends on the viscosity of the components and their dispensing flow. Further, each of the containers comprises a pumping unit for delivery of the respective component. The pumping units can be designed as a piston pump, a bellows pump, or any other suitable construction. The inventive dispenser further comprises an adjustment device for adjusting the ratio of the components of the substance to be dispensed, and a movable actuator for the pumping unit and a dispensing nozzle for the substance delivered by the dispenser.

The dispenser is characterized in that the adjusting device is variable in its distance to the container or the pumping units or the distance of projections is adjustable relative to a pivot axis of the actuator, in particular in opposing directions. Preferably, a tapered disk is rotatable around its vertical axis, or a helix-like or stairway-stepped tapered ring or a ring with for example pin-like projections is provided. The rotatable tapered disk, the rotatable tapered ring or the ring is fixed or detachably connected to the actuator or loosely associated or disposed in the manner of a thrust bearing. The rotatable tapered disk or the rotatable tapered ring has an inclined surface in respect to the horizontal and a preferably horizontally oriented supporting surface, such that these surfaces enclose an acute angle. On using that adjustment device as installed in a dispenser, the distance surface is facing the container or the pumping units and the supporting surface is facing the actuating device, but possessing in most settings (except for 50:50) a different distance to the container or pumping units.

Setting of the mixing ratio of the components takes place by changing the relative position of the tapered disk, of the tapered ring or of the projections and the associated change of the distance of the tapered disk or the tapered ring or the engagement points of the projections on the pump units or the container or container bases. Due to the formation of the tapered disk or the tapered ring the stroke of the pumping units is changed and thus the amount of the conveyed component via the respective pumping unit. The tapered disk surface or tapered ring surface is preferably designed in such a way that an opposing change in the components delivery is induced. Thus, only the dosing ratio of the components is adjusted relative to each other, but the total flow rate remains substantially constant. However, it is also possible to adjust the total delivery volume, by adjusting the position of the adjustment device relative to the pumping units or the container or by changing the height of the adjustment device. Further, the two components can be mixed, especially in an applicator according to WO 2006/111273, or if applicable, can be dispensed unmixed.

The inventive dispenser has a much simpler structure compared to the initially described dispenser, since the adjusting device is formed as a separate, simply structured unit which can be precisely adjusted relative to the pumping units. By an upright arrangement of the pumping units, the dispenser can be made compact. In addition to a direct compression of the pumping units by the adjustment device or the actuating device it is also possible to arrange the pumping units in the dispenser in a fixed manner and, mediated by the adjustment device or the actuating device, to press to the containers, which are then pressed to the pumping units with the respective strokes, wherein the discharge of a component amount is carried out, which is defined corresponding to the mixing ratio.

It is advantageous, that the actuator device is pivotable around an upright or a vertical axis of the tapered plate, the tapered ring or the ring and in the level of the actuating device. The actuator device remains constant in its distance to the containers or pumping units such that it can always pivot back or return to its original position. In an advantageous embodiment of the invention it is also possible to shift the actuating device along the vertical axis of the tapered disk, the tapered ring or the ring. The dispenser and its outer casing thus serve as an axial guide for the actuating device which dips into the dispenser when actuated to the maximum displacement depth as defined by the adjustment device, setting the component amount in the defined mixing ratio from the container according to the position of the adjustment device.

It is recommendable to form the adjustment device in a rotatable way via the actuator in order to achieve the integration of adjusting the amount and of the dispenser operation in one component. However, in addition, there is the possibility of a separate execution of adjustment and actuating such that the adjustment device has a separate rotating handle for adjusting the mixing ratio. In this connection it is advantageous, that the rotary handle is disposed on the periphery of the adjusting device, in particular at the periphery of the tapered disk, the tapered ring or ring. The rotation handle may be formed advantageously as an actuating lever or slide to adjust the rotational position of the adjustment device. In addition, there is also the possibility that a ribbing or other roughening is provided on the periphery of the tapered disk, the tapered ring or the ring, such that the rotation of the adjusting device is substantially simplified.

By adjusting the position of surface sections of the tapered disk or the tapered ring or the position of projections on the ring with respect to the pumping units, the adjustment device performs practically a thread or helical wobbling motion to the pump units, wherein the distance and thus the point of application of the adjusting device relative to the pumping units is changed. It is also advantageous that the adjustment device is continuously rotatable or having a plurality of locking positions for the defined rotation of the adjustment device. In the embodiment with continuous rotation of the adjustment device there is a free choice of the mixing ratio. In the definition of locking positions there are given adjustable mixing ratios, wherein the number of detent positions is adapted to the ultimately desired resolution of the mixture ratio.

In an advantageous manner, the actuating device is formed substantially ring- or disc-shaped, as a sleeve or as a push button. Further, it can have a pretension to the pumping units or the containers for a quick response and to return back to their resting or starting position after dosing.

In the above-described prior art there was always a direct action on both pumping units by the actuating device, i.e. there is a permanent contact. In contrast thereto, the inventive device provides that the containers or the pumping units are actuated via different spacings (exception: the middle position) quasi time-shifted by the adjustment device, wherein the ratio of the compression of the two containers or of the pumping units depends on the rotational position of the tapered disk or of the tapered ring and the defined spacing surface to the respective containers or pumping units.

In view of the outlet means provided in the device a refinement of the invention provides that the outlets are on the one hand connected to one pumping unit and on the other hand connected to the dispenser nozzle or merged together. Thus, the dispenser can be formed in a very compact manner and with low axial length. It is also possible that there is provided a mixing chamber upstream of the dispenser nozzle or the outlet means. For example, this mixing chamber can be arranged in the region between the pumping units or the containers.

Figure 4:
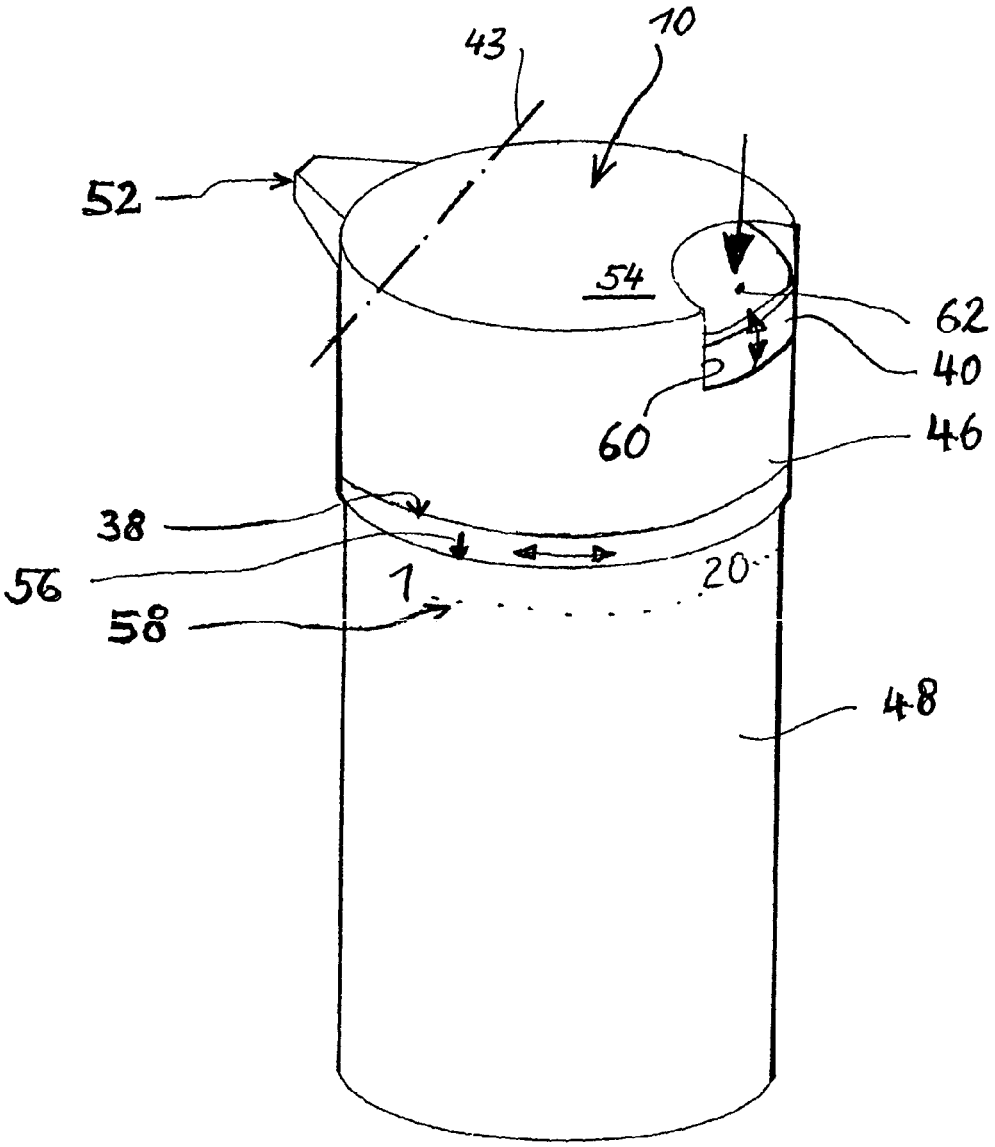
Figure 5F:
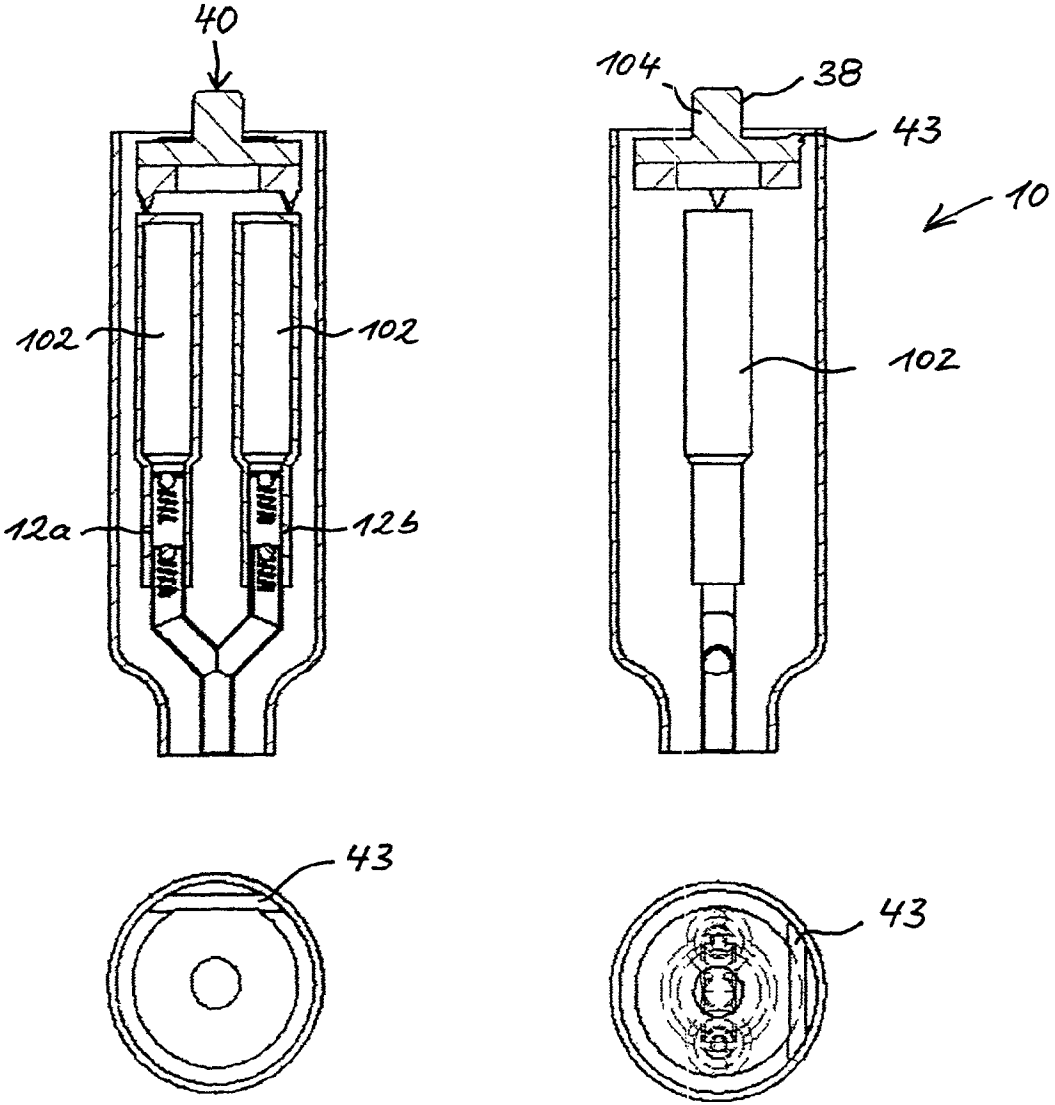
Figure 6:
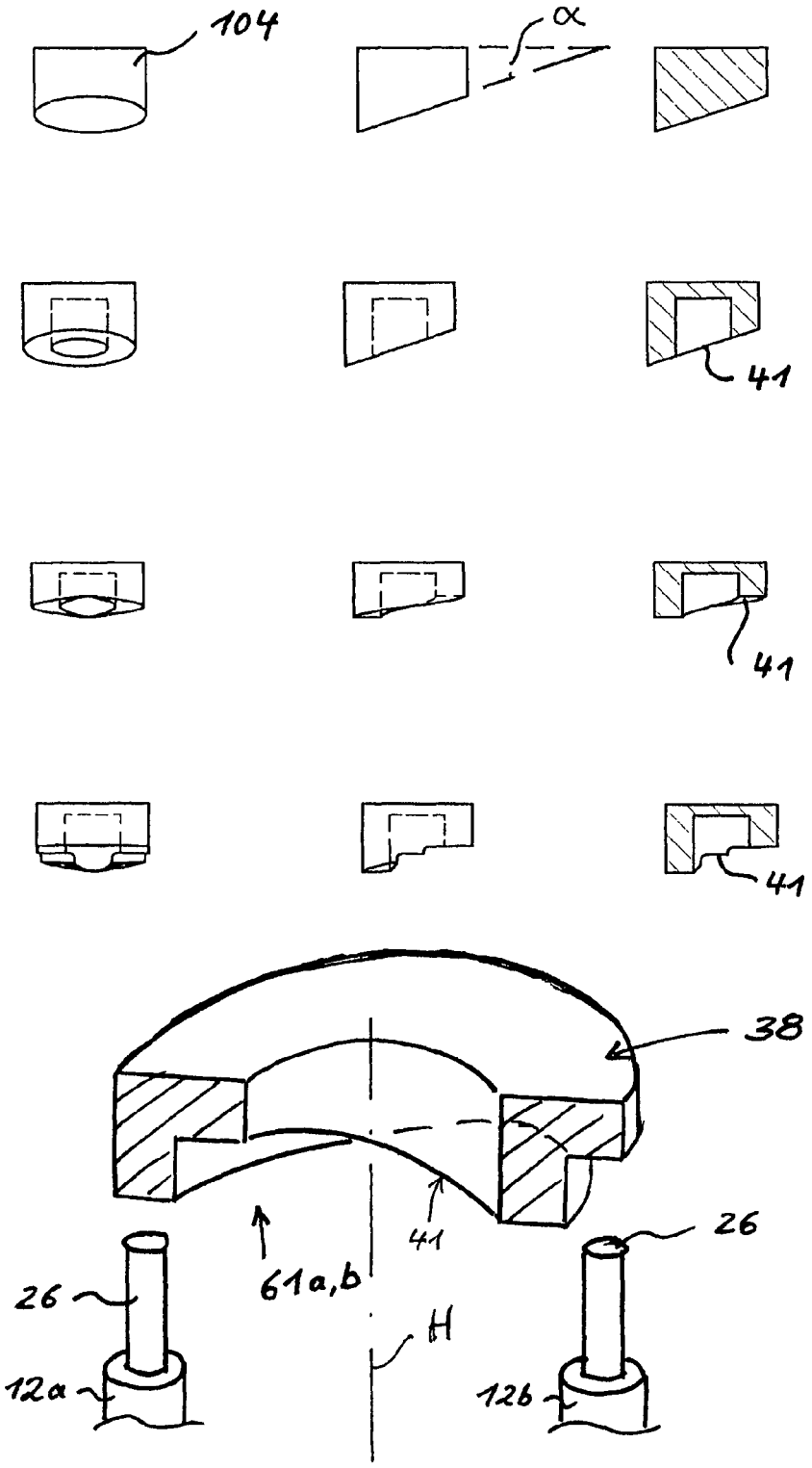

Further advantages, features and characteristics of the invention will be apparent from the following description of preferred, but non-limiting embodiments of the invention with reference to the schematic drawings, which show:

FIG. 1A-1F a schematic diagram of an adjustment device, each associated to an actuating device, in different adjustment positions relative to the pumping units, FIG. 2A-2F a further diagram of the inventive adjustment device integrated into an actuator, in different adjustment positions relative to the pumping units;

FIG. 3A is a further schematic diagram of the inventive adjustment device which acts directly on the container bottom surfaces;

FIG. 3B-3D schematically the effect of different adjustment positions on the substance release or mixing ratios of the components;

FIG. 4 a three dimensional view of a dosing dispenser with rotatable housing head;

FIG. 5A-5F several embodiments of a dosing dispenser each in sectional view in 90° rotated positions, wherein the pumping units are actuated by axially movable cartridges, and FIG. 6 five versions of the adjustment device as a combined rotation/push button.

Based on FIGS. 1A to 1F, the basic concept of the inventive dispenser 10 is described, wherein the adjustment of the mixture occurs by turning or moving of a adjustment device 38 relative to an actuating device 40. The adjustment device 38 is rotatable relative to several pumping units 12*a*, 12*b* and formed as a tapered ring in this embodiment. The tapered ring of the adjustment device 38 is pressed against the pumping units 12*a*, 12*b* by the actuating device 40. In this embodiment the tapered ring is rotatably connected to the actuating device 40 as one unit. The rotatable tapered ring of the adjustment device 38 has a distance surface 41 inclined relative to the horizontal and a horizontal supporting surface 42, such that that these surfaces 41, 42 include at their annular region an acute angle $\alpha$ of about 20° slope. The adjustment device 38 is arranged with its tapered distance surface 41 to face towards the containers 66 or the pumping units 12*a*, 12*b* and the supporting surface 42 is faced to the actuating device 40.

The actuating device 40 is exemplary formed to pivot around a vertical axis H (cf. FIG. 1*a*) of the tapered ring and in the plane of the actuating device 40 having a pivot axis 43. The actuating device 40 has a constant distance to the container 66*a*, 66*b* and the pumping units 12*a*, 12*b* and can always pivot back return to its original position. The pivot axis 43 is attached to the actuating device 40 and is set in the dispenser 10, i.e. compared to the prior art not rotated around a vertical axis, but stationary, such that the assembly is considerably simplified. According to FIG. 1A to 1F, the adjustment device 38 has a tapered ring for the inventive dispenser 10. The adjustment device 38 is rotatable around the vertical axis H (in FIG. 1A illustrated as dash-dotted line) and is further displaceable along the vertical axis H. In its middle position, the adjustment device 38 fits with its distance surface 41 on a piston 26 of two pumping units 12*a* and 12*b* each or will be brought into contact, such that in FIG. 1A a staggered pump stroke occurs, namely, first at the right piston and then with a time-shift the left piston. The operation occurs in the embodiment by pressing on the actuating device 40, pivoting around the stationary pivot axis 43.

Figure 1B:
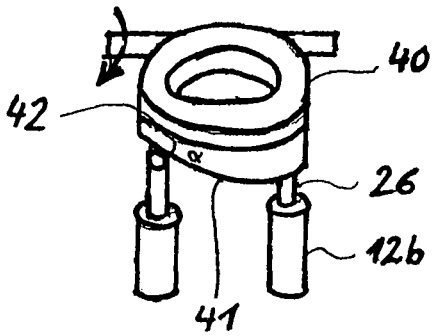
Figure 1C:
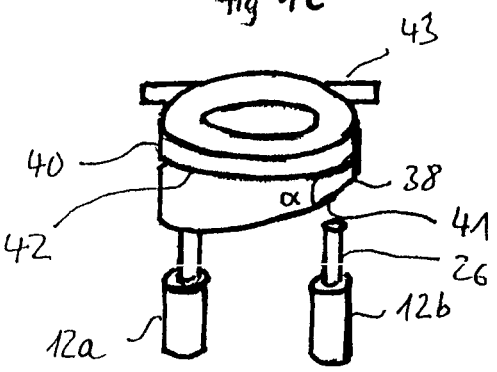
Figure 1D:
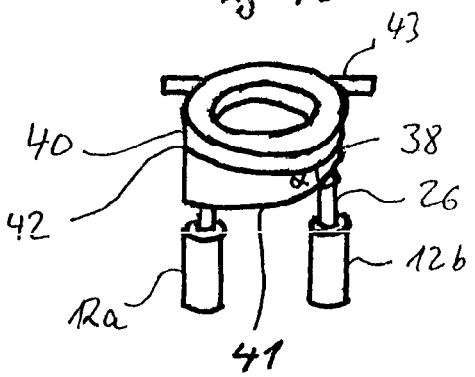
Figure 1E:
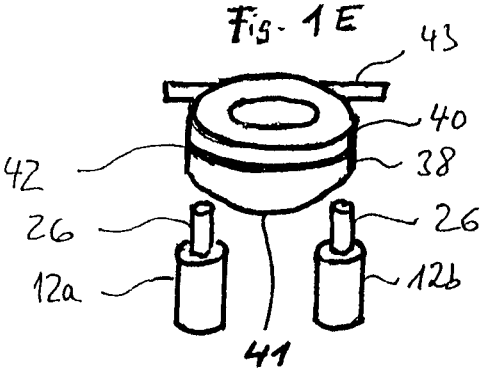
Figure 1F:
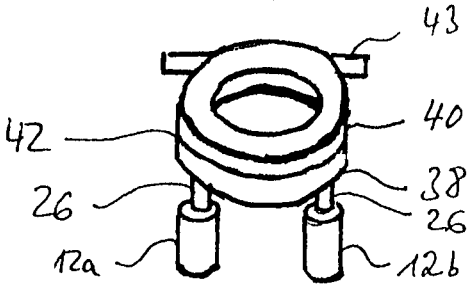
Figure 2A:
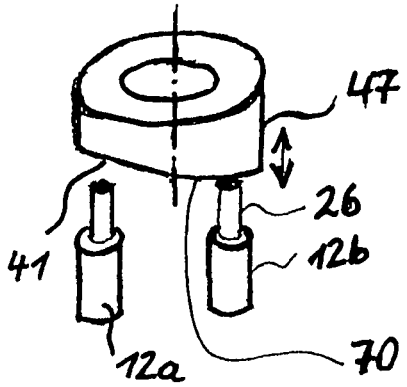
Figure 2B:
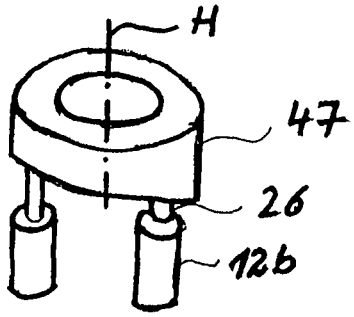
Figure 2C:
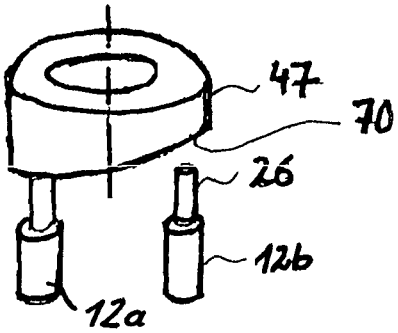
Figure 2D:
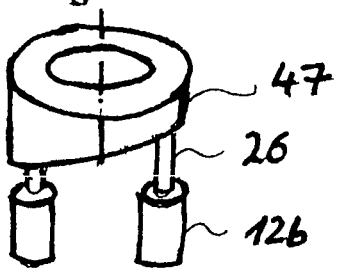
Figure 2E:
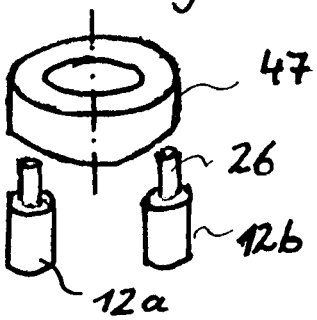
Figure 2F:
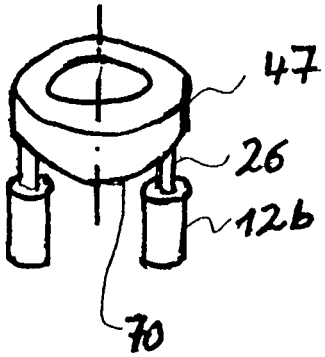

FIGS. 1A, 1C and 1E respectively show the state in which the actuating device 40, being in this embodiment annular or disc-shaped, is not pivoted around the pivot axis 43 and FIGS. 1B, 1D and 1F respectively show positions, in which the actuating device 40 is pressed downwards and pivoted around the pivot axis 43.

The pivoting or compression of the actuating device 40 around the pivot axis 43 may be made via a manually operable portion 62 at the nozzle head 46, in which the outlet or dispensing nozzle 52 (see FIG. 4) can be arranged for the mixture, as well. Further, the adjustment device 38 with this nozzle head 46 can be rotated so that different surface areas of the tapered ring of the adjustment device 38 face to the pumping units 12*a* and 12*b*, as indicated in FIGS. 1A to 1F. The actuating device 40 can be mounted by means of the pivot axis 43 in a bearing or holder, which is fixedly connected within the nozzle head 46. By a corresponding rotation of the adjustment device 38 which is rotatable below the actuating device 40 a new mixing ratio is set. The annular surface 42 between these components acts as an axial bearing surface that permits a relative rotation of the tapered ring of the adjustment device around the vertical axis H.

When the adjustment device 38 is pressed down according to the position in FIG. 1A, for example by depressing the actuating portion 62 on the nozzle head 46 or the actuating device 40, only the piston 26 of right pumping unit 12*b* is compressed as in FIG. 1B. Thus, the pumping unit 12*b* has a stroke or a volume of 100%. The left pumping unit 12*a*, which is not subjected to a compression force, since it is still below the surface 42 with the shortest distance between first and second surfaces 41, 42 and thus the lowest height of the tapered ring, has a stroke or a delivery volume of 0% (based on the total output quantity). Thus, the discharge amount contains only the component of the pumping unit 12*b*. If the adjustment device 38 is rotated, for example via the nozzle head 46 or other suitable device around 180° relative to the position shown in FIG. 1A, the adjustment device 38 assumes in its resting state the position according to FIG. 1C, in which the surface region with the greatest height of the tapered ring is arranged above the piston 26 of the left pumping unit 12*a*. If, starting from the position shown in FIG. 1C, the actuating device 40 is pressed downwards about the pivot axis 43, then the left pumping unit 12*a* effects a stroke (delivery volume 100%), while the right pumping unit 12*b* performs no stroke or has a delivery volume of 0%. The discharge amount contains only the component from the pumping unit 12*a*.

With a rotation of the adjustment device 38, starting from the position shown in FIG. 1A or 1C around 90° into a middle position between the two aforementioned extremes, the tapered ring of the adjustment device 38 takes the position as shown in FIG. 1E. In this middle position the distance surface 41 has the same distance to both pumping units 12*a* and *b*. If, starting from the position shown in FIG. 1E, the adjustment device 38 is pressed downwards, such that both pistons 26 of the pumping units 12*a*, 12*b* are pressed downwards by the same distance so that both pumping units 12*a*, 12*b* have an identical stroke or a delivery volume of 50% of the total output quantity at the same time. The dispensed mixture contains equal parts of the two components. For intermediate positions of the adjusting device 38 between the aforementioned positions correspondingly intermediate conditions between the strokes or delivery volumes of the pumping units 12*a*, 12*b* are set, so that each component ratio between 0%-100% and 100%-0% is varied.

In the above embodiment, the pivot axis 43 can be formed tangentially at the peripheral edge of the ring- or plate-shaped actuating device 40 for protruding bearing journals. It is a kind of pivoting handle, while the actuation in a type of axial guidance is described below.

The embodiment illustrated in the FIGS. 2A to 2F includes the adjustment device 38 of FIGS. 1A to 1F for the actuating device 40. Here the combined adjustment/actuating device 47 is axially moved along its vertical axis H. The adjustment/actuating device 47 is rotated for adjusting the mixing ratio, such that the corresponding surface sections as noted above are positioned above the pumping units 12*a*, 12*b* and the associated pistons 26. The adjustment/actuating device 47 is designed as an annular hollow body that is faced with its helical surface area 70 (with a pitch angle α of about 15°) to the pumping units 12*a*, 12*b* and is shifted or movable towards the piston 26 (see vertical double arrow in FIG. 2A).

FIG. 3A shows another schematic diagram of the inventive adjustment device 38 which here acts directly on the bottom surfaces 67 of the containers 66*a*, 66*b*. Instead of a wedge-shaped element as above, the adjustment device 38 has, in this embodiment, pin-like projections 61*a*, 61*b*, which can be applied to the bottom surfaces 67 of the container 66*a*, 66*b* at different times by pivoting the actuating device 40. In dependence on the rotational position of the adjustment device 38 one of the pin-like projections (here 61*b*), as shown in FIG. 3A, is positioned near the pivot axis 43, so that, for example, upon depression of the actuating device 40 no action takes place on container 66*a*, in FIG. 3A the right one. FIG. 3B to 3D shows schematically the effect of various setting positions or positioning of the pin-like projections 61*a*, 61*b* more or less near the schematically indicated pivot axis 43 on the substance delivery or mixing ratios of the components.

In the embodiments of FIGS. 1 and 2, the piston 26 of the pumping units 12*a*, 12*b* are actuated directly or indirectly via the actuating device 40 and the adjustment device 38. A kinematic reversal may be that the adjustment device 38 acts on movable containers 66*a*, 66*b* guided within a housing 48, and hence impinge the pumping units 12*a*, 12*b*. Thus, the pistons 26 may be fixedly mounted in the housing 48, while the container 66*a*, 66*b* are slidable. Conversely, the pistons 26 may be fixed and associated with the containers 66*a*, 66*b* in the housing 48.

FIG. 4 shows a simplified view of an inventive dispenser 10 with the housing 48 in which the containers 66*a*, 66*b* (see FIG. 3A) for the components are arranged as described below in more detail. The housing 48 carries the rotatable housing head 46 on which a dispensing nozzle 52 is formed. The mixture ratio is adjusted via the stroke of the pumping units 12*a*, 12*b*. This setting of the mixture is made by twisting the adjustment device 38 with respect to the housing 48 that is associated to the nozzle or housing head 46, wherein, for example at the nozzle or housing head 46, a mark 56 is applied, which is contacted in overlap with a scale 58 to set a predetermined dosing ratio. In the embodiment shown in FIG. 4 the inventive concept should be realized in accordance to the FIGS. 1A to 1F, i.e. the adjustment device 38 is rotated independently of the nozzle or housing head 46.

In the illustrated embodiment, aperture 60 is cut free in the range of the peripheral edge of the end surface 54, such that an actuating section 62 of the actuating device 40 is formed. This actuating section 62 is at the maximum distance from the schematically indicated pivot axis 43 so that the actuating device 40 is pivoted by applying an actuating force to the actuating section 62 and thus a delivery stroke of the pumping units 12*a*, 12*b* is induced. Of course, the cut-free nozzle or housing head 46 can also be used in the embodiment illustrated in FIG. 2A, 2B, with the adjustment/actuating device 47. Alternatively, the housing head 46 may be also guided axially displaceable on the housing 48, wherein, for example, an actuating pin can be formed at the inner surface of the nozzle or housing head 46, that is engageable by the axial displacement of the housing head 46 in abutment against the adjustment device 38, so that a displacement occurs along the vertical axis H.

An embodiment based on a "reverse kinematics" is schematically shown in FIG. 5A. Accordingly, in the housing 48 of the dispenser 10 again two pumping units 12*a*, 12*b* are included which are designed in piston form. The pistons 26 are fixedly mounted in the housing 48 and are formed as so-called hollow piston, wherein the outlet or pressure valves are formed in a pressure channel 74 that is connected to the piston 26. The individual pressure channels 74 of the pumping units 12*a*, 12*b* can lead in a common mixing channel 96. The pumping units 12*a*, 12*b* are arranged axially displaceable within the housing 48 and disposed at a respective cartridge 102, in which the components are contained. In the transition region of the cartridge 102 a suction valve 72 is formed such that a back flow of the component from the chamber 68 to the cartridge 102 is prevented. The cartridges 102 are guided axially displaceable in the housing 48.

Here, the adjustment device 38 is mounted in the region of the housing 48 that is remote from the pumping units 12*a*, 12*b* and is again pivotable around its vertical axis H, namely with a combined rotation and push knob protruding out of the housing 48 (here upwards). In contrast to the aforementioned embodiments, the adjusting device 38 acts not to the piston 26, but on the cartridges 102 so that they are moved upon displacement of the adjusting device 38 in the axial direction. By this axial displacement of the cartridges 102, they are moved towards the pistons 26 so that the displacement chamber 68 is reduced (delivery stroke) or is enlarged (suction stroke). The transmission of the shift motion of the adjusting device 38 occurs in the illustrated embodiment via pins 106 which are formed at the bottoms of the cartridges 102 and are faced to the distance surface 41 with different distances (only in the middle position, the distances are equal). Here, the helical configuration of the distance surface 41 is clearly visible, wherein a step-like design of this thread-like surface is possible, as well if a setting in many steps is desired instead of a continuous variation.

In the above-described embodiment, the components are fed to a common, central mixing chamber 92. In principle, the individual components, however, could also be fed separately to the mixing channel 96 or to the dispensing nozzle 52 so that no internal mixing takes place. The dispensing nozzle 52 may leave in the radial direction or centrally from the end surface 54. As mentioned above, however, an applicator is preferred as provided in WO2006/111273, since this allows a particularly intensive mixing. To reduce the operating forces during mixing high-viscosity components, appropriate handles can be fixed on the actuating device 40, by achieving a greater leverage.

An example is shown in FIG. 5B, wherein the rotation and pressure knob as a combined actuating device 40 and adjustment device 38 has a larger diameter than in FIG. 5A. Since the structure of the dispenser 10 is otherwise identical, only the essential references are inserted. The same applies to the embodiment of the dispenser 10, illustrated in FIG. 5C, which is here disposed "overhead", wherein the dispensing nozzle 52, indicated in dashed lines, is radially or laterally guided out. In FIG. 5C the diameter is maximized to such an extent that the outer shell of the housing 48 is formed as well tangible rotating sleeve, such as the adjustment device 38, which is used upon compression or axial stroke according to the arrow as large area actuating device 40. The embodiment shown in FIG. 5D is similar to FIG. 5B, wherein a relatively large pressure and rotary knob combines the actuating device 40 and the adjustment device 38, wherein the distance surface 41 is here formed as a wedge surface.

In FIG. 5E the dispenser 10 is dimensioned and constructed similar to FIG. 5C, however, it uses the fixed pivot axis 43 with an adjacent adjustment device 38 as described in connection with FIG. 3A, at which again the projections 61*a, b* are formed integrally for acting on the cartridges. This structure is also used in the dispenser 10 of FIG. 5F, wherein the adjusting knob 104 is formed as the actuating device 40 and adjustment device 38 similar to FIG. 5A. In the corresponding top view the orientation of the pivot axis 43 is clearly visible.

FIG. 6 shows several types of the combined rotation/push button 104, each shown in side view and in cross section. The wedge-shaped design (with the ramp angle $\alpha$) on the distance surface 41 is illustrated as well as the coil-shaped design and type of stairway-like steps. In the adjustment device 38 as shown at the bottom it is of particular importance that two counter-rotating helices are provided as projections 61*a, b* thus combining the above alternatives. One piston 26 faces to the outer thread (as a projection 61*a*) and the other piston 26 of the second pumping unit faces to the inner thread (as a projection 61*b*) for actuation. It is also possible that both pumping units 12*a, b* may be arranged on the same radius to the central vertical axis H. Thus, even more than two pumping units can be actuated by the third and fourth pumping unit from the inner thread or helix. Thus, the mixing ratio can be adjusted in opposing directions by simply rotating around the vertical axis H.

REFERENCE LIST

10=dispenser
12*a, b*=pumping unit
26=piston
38=adjustment device
40=actuating device
41=distance surface
42=second surface
43=pivot axis
46=nozzle or housing head
47=adjustment/actuating device (combined)
48=housing
52=dispensing nozzle
54=end surface
56=mark
58=scale
60=aperture
61*a*, 61*b*=projections
62=section
66*a*, 66*b*=container (cartridge)
67=bottom surface
68=chamber
70=surface area
72=suction valve
74=channel
92=mixing chamber
96=mixing channel
102=cartridge
104=combined rotation/push button
106=journal
108=bottom
H=vertical axis

The invention claimed is:

1. A dispenser for delivery of a substance consisting of at least two components, comprising:

at least two containers for containing the components of a substance;

a pumping unit at each of the containers;

an adjusting device for adjusting the proportion of the components of the substance;

a movable actuator for the pumping units, and a dispensing nozzle for the substance to be delivered by the dispenser, wherein the adjusting device is adjustable to vary the distance between a surface of the actuator and the containers or the distance between the surface and the pumping units, or the distances between projections and the containers or the pumping units which projections are adjustable relative to a pivot axis of the actuator, in opposing directions while the pivot axis remains fixed in relation to the pumping units, and wherein dispensing is achieved by the surface of the actuator or the projections moving through the distance or distances, respectively, to contact and to drive the containers or the pumping units.

2. Dispenser according to claim 1, characterized in that the pivot axis of the actuator is arranged at the level of the actuator and is stationary relative to a dispenser housing.

3. Dispenser according to claim 1, characterized in that the actuator is adapted to be displaceable along a vertical axis, wherein the dispenser has a guide for the actuator.

4. Dispenser according to claim 1, characterized in that the adjusting device is rotatable via the actuator or has a separate turning handle.

5. Dispenser according to claim 4, characterized in that the turning handle has an actuating or slide lever for adjusting the rotational position of the adjusting device.

6. Dispenser according to claim 4, characterized in that the turning handle is arranged on the periphery of the adjusting device.

7. Dispenser according to claim 6, characterized in that the turning handle has an actuating or slide lever for adjusting the rotational position of the adjusting device.

8. Dispenser according to claim 1, characterized in that the adjusting device is continuously twistable or has a plurality of locking positions for defined rotation of the adjusting device.

9. Dispenser according to claim 1, characterized in that the containers or the pumping units are compressed via the adjusting device, wherein the ratio of compression of the containers or of the pumping units is dependent on the distance of a distance surface to the respective containers or pumping units.

10. Dispenser according to claim 1, characterized in that the pumping units are connected with the dispensing nozzle.

11. Dispenser according to claim 1, characterized in that the actuator is formed substantially ring- or disc-shaped, as a sleeve or as a push button.

12. Dispenser according to claim 1, characterized in that the containers or the pumping units are compressed via the adjusting device, wherein the ratio of compression of the containers or of the pumping units is dependent on the distance of projections to the respective containers or pumping units.

13. Dispenser according to claim 1, characterized in that the adjusting device is formed as rotating tapered disk or as helix-like tapered ring, associated to the actuator, with a distance surface inclined to the horizontal or angled stepped or as a ring with projections, facing to the containers or to the pumping units of the actuator.

14. Dispenser according to claim 13, characterized in that the adjusting device and the actuator form one piece, in particular as a combined rotation/push button.

15. Dispenser according to claim 13, characterized in that the adjusting device is rotatable around a vertical axis.

16. Dispenser according to claim 15, characterized in that the adjusting device and the actuator form one piece, in particular as a combined rotation/push button.

* * * * *